United States Patent [19]

Ishida

[11] 4,275,463

[45] Jun. 23, 1981

[54] ELECTRONIC TIMEPIECE

[75] Inventor: Takashi Ishida, Tokyo, Japan

[73] Assignee: Kabushiki Kaisha Daini Seikosha, Tokyo, Japan

[21] Appl. No.: 58,170

[22] Filed: Jul. 17, 1979

[30] Foreign Application Priority Data

Jul. 19, 1978 [JP] Japan ..... 53-88053

[51] Int. Cl.[3] ..... G04C 9/00

[52] U.S. Cl. ..... 368/187; 368/188; 368/190

[58] Field of Search ..... 58/23 R, 23 D, 50 R, 58/85.5; 368/184–190

[56] References Cited

U.S. PATENT DOCUMENTS

| | | | |
|---|---|---|---|
| 3,871,168 | 3/1975 | Maire et al. | 58/85.5 X |
| 3,928,959 | 12/1975 | Naito | 58/85.5 X |
| 4,030,283 | 6/1977 | Sauthier et al. | 58/85.5 X |
| 4,030,284 | 6/1977 | Portmann | 58/85.5 X |
| 4,034,551 | 7/1977 | Ushiyama | 58/23 R X |
| 4,067,187 | 1/1978 | Sekiya et al. | 58/23 R |
| 4,092,822 | 6/1978 | Droz et al. | 58/85.5 X |

*Primary Examiner*—Ulysses Weldon

*Attorney, Agent, or Firm*—Robert E. Burns; Emmanuel J. Lobato; Bruce L. Adams

[57] ABSTRACT

An electronic timepiece having a stepping motor which can be driven at a normal frequency and at a relatively faster correction frequency includes a manually actuable switch and circuitry responsive to two successive actuations of the switch within a first predetermined time period for effecting a change in the motor drive from the normal frequency to the correction frequency and responsive to a third actuation of the switch after a predetermined time period from said change, to return the motor drive to the normal frequency.

3 Claims, 5 Drawing Figures

ELECTRONIC TIMEPIECE

BACKGROUND OF THE INVENTION

The present invention relates to an electronic timepiece having a time adjusting function with an electronic fast forward system.

In the conventional type, a mechanical transmitting mechanism is employed, therefore, a plurality of gear wheels and a space therefor are necessary. As a result, an electronic timepiece having an electric contact and a time adjusting system controlling an output period of a drive circuit is developed. However, the operation in the conventional type is not so convenient in view of the ON and OFF control of said contact member.

SUMMARY OF THE INVENTION

The present invention aims to eliminate the above noted difficulty and insufficiency and the object of the present invention is to provide an electronic timepiece having an operation feeling which is equal to the conventional mechanical time adjusting function by operating the stem.

DETAILED DESCRIPTION OF THE INVENTION

The preferred embodiment of the present invention are now described with reference to FIGS. 1–5.

Figure 1:
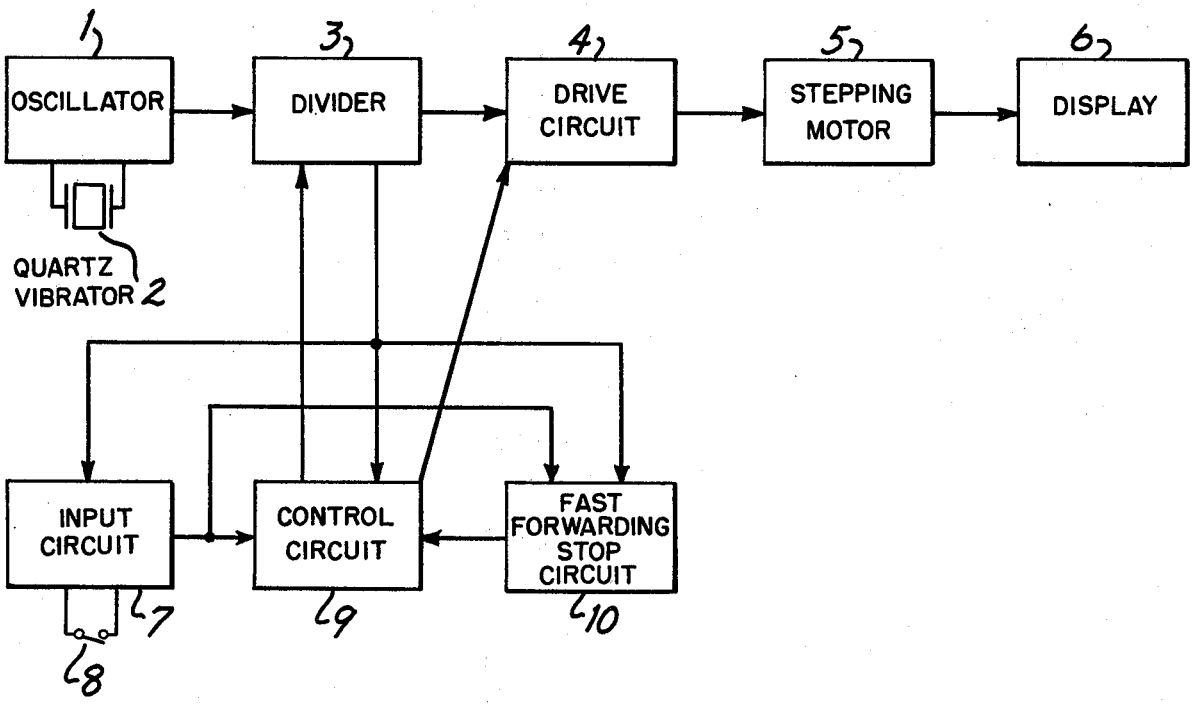
FIG. 1 shows a block diagram of an electronic timepiece according to the present invention.

FIG. 1 shows a block diagram of the present invention, a divider 3 is connected to an oscillator 1 having a quartz vibrator 2, an output of the divider 3 is connected to the input circuit 7, control circuit 9, fast forwarding stop circuit 10 and drive circuit 4.

The outputs of the input circuit 7 and fast forwarding stop circuit 10 are applied to the control circuit 9, whereby drive circuit 4 is controlled. The output of the input circuit 7 is applied to the fast forwarding stop circuit 10. The drive circuit 4 is connected to a step motor 5 which is connected to a display device 6.

The operation of the present invention will now be described.

A time standard signal is generated by the oscillator 1 having the quartz vibrator 2. The divider 3 divides the output of the oscillator 1 and generates a pulse signal for each circuit. The input circuit 7 generates one pulse signal having a certain pulse width according to the timing by the ON and OFF operation of the contact member 8 whereby chattering is prevented. The control circuit 9 counts the number of input pulses from the input circuit 7 and is able to change the mode thereof to the fast forwarding mode by changing the output period of the drive circuit 4 according to two pulses reclined in a certain period. At this time, the input from the input circuit 7 is applied to the fast forwarding stop circuit 10 whereby the control circuit 9 is reset and the output of the drive circuit 4 is reset to a normal condition.

Figure 3:
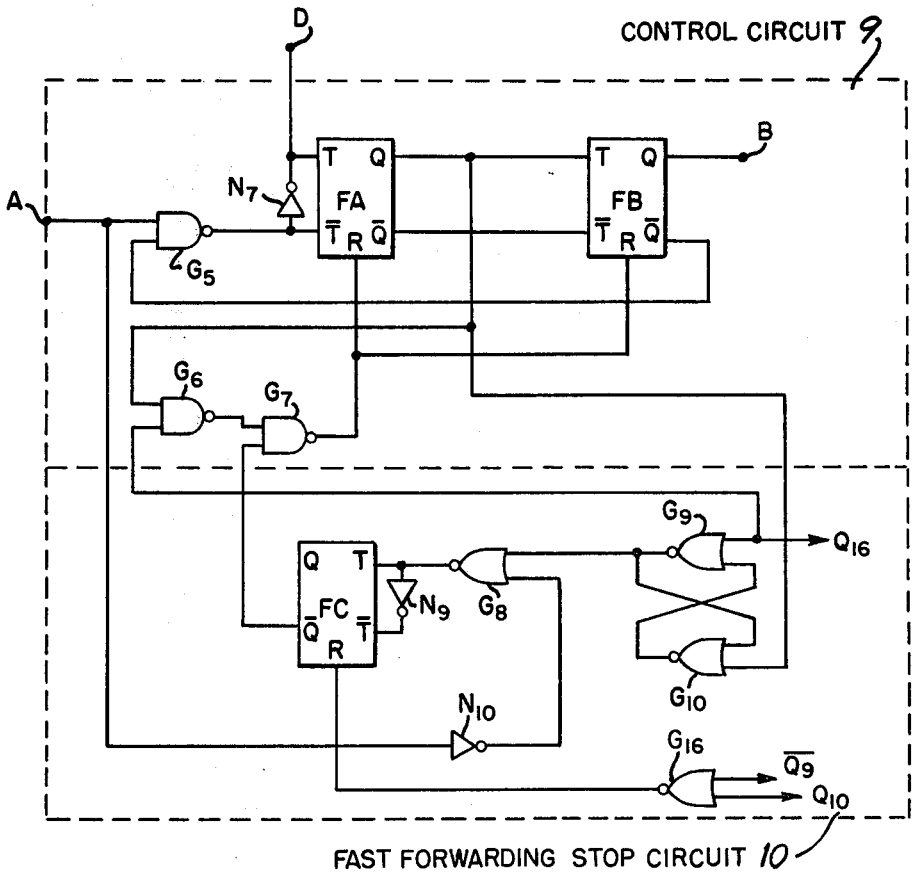
FIG. 3 shows a detailed circuit construction including a control circuit and a fast forwarding stop circuit of the present invention.

FIG. 3 shows a detailed circuit construction of the control circuit and fast forwarding stop circuit 10, with the output of the input circuit 7 is connected to NAND-gate "G5" and inverter "N10" through the terminal "A", the output $\overline{Q}$ of T-flip flop FB is applied to NAND-gate "G5", the output of NAND-gate "G5" becomes the input T to flip-flop FA through input $\overline{T}$ and inverter N7 and is applied to a reset terminal "D" on and after the 11th stage of divider 3. The inputs T and $\overline{T}$ of $\overline{T}$-flip flop FB are connected to the output Q and $\overline{Q}$ of T-flip flop FA, the output Q of T-flip flop FB is connected to the output for the drive circuit 4.

The reset terminals R of T-flip flop FA and FB are connected to the output of NAND-gate G7, the outputs of NAND-gate G6 and $\overline{Q}$ T-flip flop FC are applied to the inputs of NAND-gate G7. The output Q of T-flip flop FA and the output Q16 of the 16th stage of the divider 3 are applied to the inputs of NAND-gate G6.

The output of NOR-gate G8 is applied to the T input of T-flip flop FC and is applied to the input "$\overline{T}$" through inverter N9. The output of N10 and NOR-gate G9 are applied to NOR-gate G8. NOR-gates G9 and G10 comprise an RST-flip flop, with the output Q16 of divider 3 and the output of NOR-gate G10 applied to the inputs of NOR-gate G9, and the input of NOR-gate G10 connected to the output terminal Q of T-flip flop FA.

A reset terminal of T-flip flop FC is connected to the output of NOR-gate G16 the inputs of which have $\overline{Q}$ 9 and Q 10 are applied thereto.

The operation of the present invention will now be referred to.

One pulse signal is applied from the input circuit 7 by operating the contact member 8, whereby T-flip flop FA is inverted through NAND-gate G5. At this time, the dividing stages after the 11th stage of the divider 3 are reset. Further after one second has elapsed, T-flip flop FA is reset by the output Q (Q16) of 16th stage of the divider 3 through NAND-gates G6 and G7.

However, if the input signal is applied thereto within one second, T-flip flop FB is inverted by inverting T-flip flop FA, whereby the output terminal B is changed from LOW to HIGH (referred to L and H) and the drive circuit 4 is controlled and the fast forwarding operation is started. At this time, within one second after the second input pulse has come, the output of NOR-gate G9 is "H" whereby the third pulse signal "A" through N10 is inhibitted by NOR-gate "G8" and is not applied to T-flip flop FC as an input signal. However, one second later, the input signal of NOR-gate G9 becomes "L" according to Q16, if the input pulse is applied thereto, T-flip flop FC is inverted, T-flip flops FA and FB are reset by the output $\overline{Q}$, then the condition of the timepiece turns to a normal stepping condition.

Figure 5:
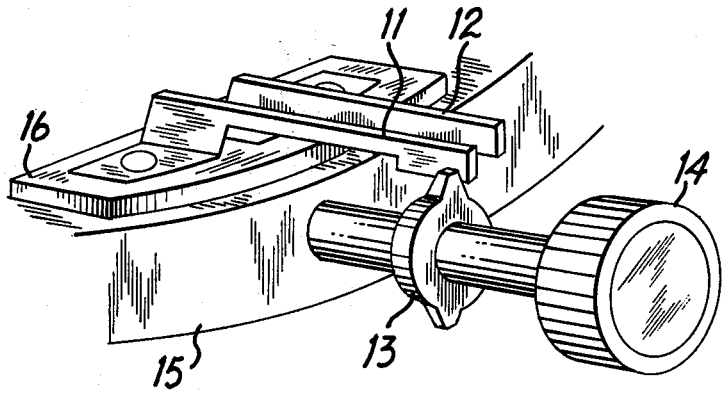
FIG. 5 shows a perspective view of the contact member of the present invention.

FIG. 5 shows a perspective view of an embodiment of the stem switch comprising a stem 14 having a cam member 13 and rotatably mounted to a base plate 15 and switch plates 11 and 12 which are insulated from the base plate 15 and mounted thereon. The cam member 13 is rotated according to the rotation of the stem member 14 whereby the switch plate 11 is contacted to the switch plate 12. The switch plate 11 departs from the switch plate 12 when the cam member 13 is fully rotated. Therefore, the switch turns OFF and ON by a rotation of the stem 14.

Figure 2:
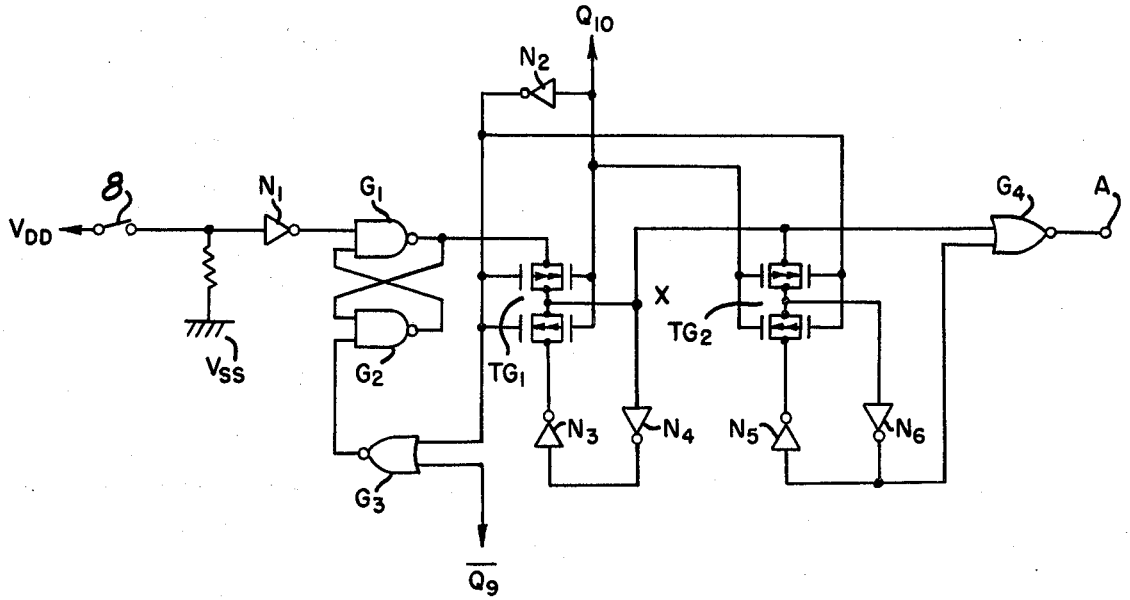
FIG. 2 shows a detailed circuit construction of the input circuit of the present invention.

FIG. 2. shows the embodiment of a detailed circuit construction of the input circuit 7, including the contact member 8 connected to the input terminal of inverter N1, the output thereof applied to the input of NAND-gate G1. NAND-gates G1 and G2 constitute an RS-flip flop, the output of the RS-flip flop being applied to the input of the latch circuit which is composed of the transmission gate TG1 and inverters N3 and N4.

The output Q10 of the 10th stage of the divider 3 is connected to a gate electrode of an N-channel transistor at the input side of transmission-gate TG1, the output of inverter N2 is connected to a gate electrode of a P-channel transitor and applied to NOR-gate G3 together with $\overline{Q}$9. The output of NOR-gate G3 is applied to NAND-gate G2. The output of the latch circuit is applied to another latch circuit which is composed of the transmission-gate TG2 and inverters N5 and N6. The output of inverter N2 is connected to a gate electrode of an N-channel transistor of TG2 at the input side and Q10 is connected to a gate electrode of a P-channel transistor. The output of inverter N6 and the terminal X are applied to NOR-gate G4 having an output terminal A.

The operation of the embodiment of FIG. 2 will now be explained.

The output of NAND-gate G1 becomes "H" by closing the contact member 8, the output signal of NAND gate G2 is changed to "L" by the signal "H" of NAND-gate G1, and the "L" condition of NAND-gate G2 is maintained until after the contact member 8 is opened. The transmission-gates TG1 and TG2 are in the receiving and keeping condition when the output Q10 of the 10th stage of the divider 3 is "H" and further are in the keeping and receiving condition when the output Q10 of the 10th stage of the divider 3 is "L" whereby both of the transmission gates become "H" within one period of Q10. When the contact member 8 is opened and NOR-gate G3 becomes "L", NAND-gate G1 is changed to "L". At this time, the output signals of transmission-gates TG1 and TG2 become "L", with the transmission gate TG2 delayed by a half period with respect to the output Q10. A half period pulse of the output Q10 is generated from NOR-gate G4 is which the reversed output of the latch in the latter stage and the output of the latch in the former stage are applied thereto by operating ON and OFF of the contac member 8.

Figure 4:
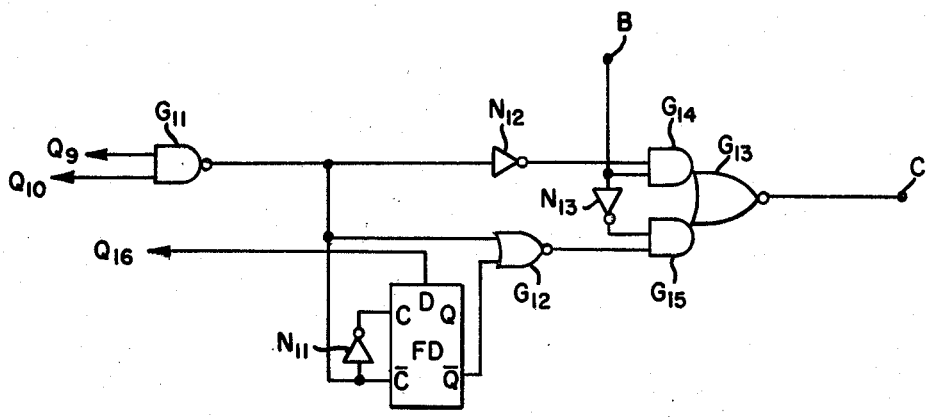
FIG. 4 shows a detailed circuit construction of a part of the drive circuit of the present invention.

FIG. 4 shows a detailed circuit construction of a part of the drive circuit 4, wherein the outputs Q9 and Q10 of the 9th and 10th stages of the divider 3 are applied to NAND-gate G11, the output of NAND-gate G11 is applied to inverters N12 and N11 and applied to the input $\overline{C}$ of D-flip flop FD and the output of inverter N11 is applied to the input C of D-flip flop FD. The output $\overline{Q}$ of D-flip flop FD is applied to the input of NOR-gate G12 together with the output of NAND-gate G11, the output of NOR-gate G12 is applied to the input of AND-gate G15. The output of inverter N12 is applied to the input of AND-gate G14 together with the input of termimal B. The input terminal B is connected to the input of inverter N13, the output of inverter N13 is applied to the input of AND-gate G15. The output of NOR-gate G13 is connected to the output terminal C and the inputs of NOR-gate G13 are connected to the outputs of AND-gates G14 and G15.

The operation of the present embodiment in FIG. 4 will now be explained.

NAND-gate G11 generates the fast forwarding pulse having the pulse width 7.8 msec and frequency 32 HZ. D-flip flop FD and NOR-gate G12 generate one pulse of 7.8 msec at the output of NOR-gate G12 according to the trailing edges of Q16. Therefore, when the input terminal B is "H", AND-gate G14 is opened whereby the fast forwarding operation is performed. On the other hand, when the input terminal B is "L", AND-gate G15 is opened whereby the normal drive output is generated to the selection output terminal "C".

According to the present invention, the normal step operation is easily changed to the fast forwarding operation by two operations of the contact member in a certain period (i.e., one second in the present embodiment), further the fast forwarding operation is stopped by the operation of the contact member at a certain time (about more than one second) later.

Further one is able to obtain an electronic timepiece having an electronic hands adjusting mechanism which is as easily operated as the conventional mechanical hands adjusting function.

Furthermore one is able to obtain a preferred value of the member of operations per second by combining the number of gears of cam 13 and the outer diameter of stem 14. And one is able to reverse the motor in the fast forwarding mode in addition to the normal fast forwarding mode; as shown in the present embodiment, where the contact member 8 is changed to another contact member in which the stem is rotated in right and left directions respectively, whereby the reverse or normal rotation is controlled.

I claim:

1. In an electronic timepiece having a stepping motor and controllable means for driving the motor alternatively at a normal frequency and a relatively faster correction frequency, the improvement comprising: manually actuatable switching means; and means connected to said controllable means and responsive to two successive actuations of the switching means within a first predetermined time period for causing said controllable means to effect a change in the motor drive from the normal frequency to the correction frequency and responsive to a third actuation of the switching means after a second predetermined time period from said change for causing said controllable means to effect return of the motor drive to the normal frequency.

2. The timepiece according to claim 1; wherein the switching means comprises a rotatable stem, and switching contacts actuatable in response to the rotation of the stem.

3. The timepiece according to claim 2; wherein the switching means produces at least one actuation for each revolution of the stem.

* * * * *